US011417979B2

(12) United States Patent
Lovitz et al.

(10) Patent No.: US 11,417,979 B2
(45) Date of Patent: Aug. 16, 2022

(54) SHIELDED ELECTRICAL CONNECTOR ASSEMBLY AND METHOD OF MANUFACTURING SAME

(71) Applicant: Aptiv Technologies Limited, St. Michael (BB)

(72) Inventors: William C. Lovitz, Niles, OH (US); Patrick J. Reedy, Youngstown, OH (US); Glenn E. Robison, Youngstown, OH (US); Michael L. Mellott, Youngstown, OH (US); Jeffrey A. Janis, Warren, OH (US); Bruce D. Taylor, Corland, OH (US); Steven P. Ragalyi, Cortland, OH (US); Christopher D. Hanton, Cortland, OH (US); Hoi Lui, Warren, OH (US)

(73) Assignee: APTIV TECHNOLOGIES LIMITED

( * ) Notice: Subject to any disclaimer, the term of this patent is extended or adjusted under 35 U.S.C. 154(b) by 155 days.

(21) Appl. No.: 16/629,824

(22) PCT Filed: Jul. 24, 2018

(86) PCT No.: PCT/US2018/043440
§ 371 (c)(1),
(2) Date: Jan. 9, 2020

(87) PCT Pub. No.: WO2019/027730
PCT Pub. Date: Feb. 7, 2019

(65) Prior Publication Data

US 2021/0376531 A1 Dec. 2, 2021

Related U.S. Application Data

(60) Provisional application No. 62/539,656, filed on Aug. 1, 2017.

(51) Int. Cl.
*H01R 13/187* (2006.01)
*H01R 13/05* (2006.01)
(Continued)

(52) U.S. Cl.
CPC ..... *H01R 13/187* (2013.01); *H01R 13/05* (2013.01); *H01R 13/052* (2013.01);
(Continued)

(58) Field of Classification Search
CPC H01R 13/6588; H01R 13/659; H01R 13/187; H01R 13/052; H01R 13/113;
(Continued)

(56) References Cited

U.S. PATENT DOCUMENTS 5,480,326 A * 1/1996 Chen ..... H01R 25/006 439/108
6,234,841 B1 * 5/2001 Chang ..... H01R 13/659 439/607.25
(Continued)

FOREIGN PATENT DOCUMENTS

CN 106374282 A 2/2017
JP 11195458 A 7/1999

OTHER PUBLICATIONS

Chinese Office Action for CN Application No. 201880050290.7, dated May 18, 2021, 16 pages.
(Continued)

*Primary Examiner* — Gary F Paumen
(74) *Attorney, Agent, or Firm* — Billion & Armitage

(57) ABSTRACT

A shielded electrical connector assembly includes an electromagnetic shield integrally formed from a single sheet of conductive material. The shield has a main wall and four side walls surrounding the main wall. The shield defines an opening opposite the main wall having an opening perimeter that is greater than or equal to a main wall perimeter. One of
(Continued)

the four side walls defines at least one side wall opening that is configured to receive a shielded wire cable. A method of manufacturing the shielded electrical connector assembly includes the steps of providing a single planar sheet of conductive material, providing a die and a punch, forming the sheet into a cupped shape having a main wall and four side walls surrounding the main wall using the die and the punch, and forming a side wall opening in one of the four side walls.

18 Claims, 7 Drawing Sheets

(51) Int. Cl.

| | |
|---|---|
| ***H01R 13/11*** | (2006.01) |
| ***H01R 13/193*** | (2006.01) |
| ***H01R 13/26*** | (2006.01) |
| ***H01R 13/28*** | (2006.01) |
| ***H01R 13/44*** | (2006.01) |
| ***H01R 13/502*** | (2006.01) |
| ***H01R 13/52*** | (2006.01) |
| ***H01R 13/53*** | (2006.01) |
| ***H01R 13/58*** | (2006.01) |
| ***H01R 13/62*** | (2006.01) |
| ***H01R 13/621*** | (2006.01) |
| ***H01R 13/66*** | (2006.01) |
| ***H01R 24/66*** | (2011.01) |
| ***H01R 43/16*** | (2006.01) |
| ***H01R 13/6581*** | (2011.01) |
| ***H01R 13/6592*** | (2011.01) |
| ***H01R 13/6598*** | (2011.01) |
| ***H01R 4/50*** | (2006.01) |
| *H01R 13/207* | (2006.01) |
| *H01R 13/633* | (2006.01) |
| *H01R 13/40* | (2006.01) |

(52) U.S. Cl.

CPC ..... *H01R 13/113* (2013.01); *H01R 13/193* (2013.01); *H01R 13/26* (2013.01); *H01R 13/28* (2013.01); *H01R 13/44* (2013.01); *H01R 13/502* (2013.01); *H01R 13/5202* (2013.01); *H01R 13/5208* (2013.01); *H01R 13/5219* (2013.01); *H01R 13/53* (2013.01); *H01R 13/5812* (2013.01); *H01R 13/62* (2013.01); *H01R 13/6215* (2013.01); *H01R 13/6581* (2013.01); *H01R 13/6592* (2013.01); *H01R 13/6598* (2013.01); *H01R 13/665* (2013.01); *H01R 24/66* (2013.01); *H01R 43/16* (2013.01); *H01R 4/5091* (2013.01); *H01R 13/207* (2013.01); *H01R 13/40* (2013.01); *H01R 13/6335* (2013.01); *H01R 13/6683* (2013.01); *H01R 2201/26* (2013.01)

(58) Field of Classification Search

CPC ..... H01R 13/193; H01R 13/26; H01R 13/28; H01R 13/44; H01R 13/502; H01R 13/5202; H01R 13/5208; H01R 13/5219; H01R 13/53; H01R 13/5812; H01R 13/62; H01R 13/6215; H01R 13/665; H01R 13/05; H01R 13/6581; H01R 13/6592; H01R 13/6598; H01R 13/207; H01R 13/6335; H01R 13/6683; H01R 13/40; H01R 24/66; H01R 43/16; H01R 4/5091

USPC ..... 439/607.53, 607.54

See application file for complete search history.

(56) References Cited

U.S. PATENT DOCUMENTS

| | | | | |
|---|---|---|---|---|
| 6,629,859 | B2 * | 10/2003 | Hoshino | H01R 13/658 439/607.25 |
| 7,001,216 | B1 | 2/2006 | Huang | |
| 7,416,442 | B1 * | 8/2008 | Liu | H01R 24/64 439/540.1 |
| 2003/0232539 | A1 | 12/2003 | Chen et al. | |
| 2006/0079114 | A1 | 4/2006 | Tsai | |
| 2006/0228944 | A1 * | 10/2006 | Tsai | H01R 43/18 439/607.54 |
| 2012/0270444 | A1 * | 10/2012 | Kawamura | H01R 13/5205 439/607.44 |
| 2013/0149902 | A1 | 6/2013 | Tsuchiya | |
| 2014/0017951 | A1 * | 1/2014 | Tsai | H01R 13/514 439/638 |
| 2015/0079834 | A1 * | 3/2015 | Wu | H01R 13/659 439/357 |
| 2015/0295361 | A1 * | 10/2015 | Miyoshi | H01R 13/508 439/607.58 |
| 2016/0375477 | A1 | 12/2016 | Tanaka et al. | |

OTHER PUBLICATIONS

EP Search Report for EP Application No. 18842337.0, dated Apr. 9, 2021, 26 pages.

* cited by examiner

SHIELDED ELECTRICAL CONNECTOR ASSEMBLY AND METHOD OF MANUFACTURING SAME

CROSS-REFERENCE TO RELATED APPLICATION

This application is a national stage application under 35 U.S.C. § 371 of PCT Application Number PCT/US2018/043440 having an international filing date of Jul. 24, 2018, which designated the United States, said PCT application claiming the benefit of U.S. Provisional Patent Application No. 62/539,656 filed on Aug. 1, 2017, the entire disclosure of each which is hereby incorporated by reference.

TECHNICAL FIELD OF THE INVENTION

The invention relates to an electrical connector assembly, particularly to a shielded electrical connector assembly that is capable of carrying current in excess of 200 amperes and a method of manufacturing such an electrical connector assembly.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Presented herein is a sealed electrical connector assembly that is suited for robustly, reliably, and safely carrying electrical currents greater than 200 amperes.

Figure 1:
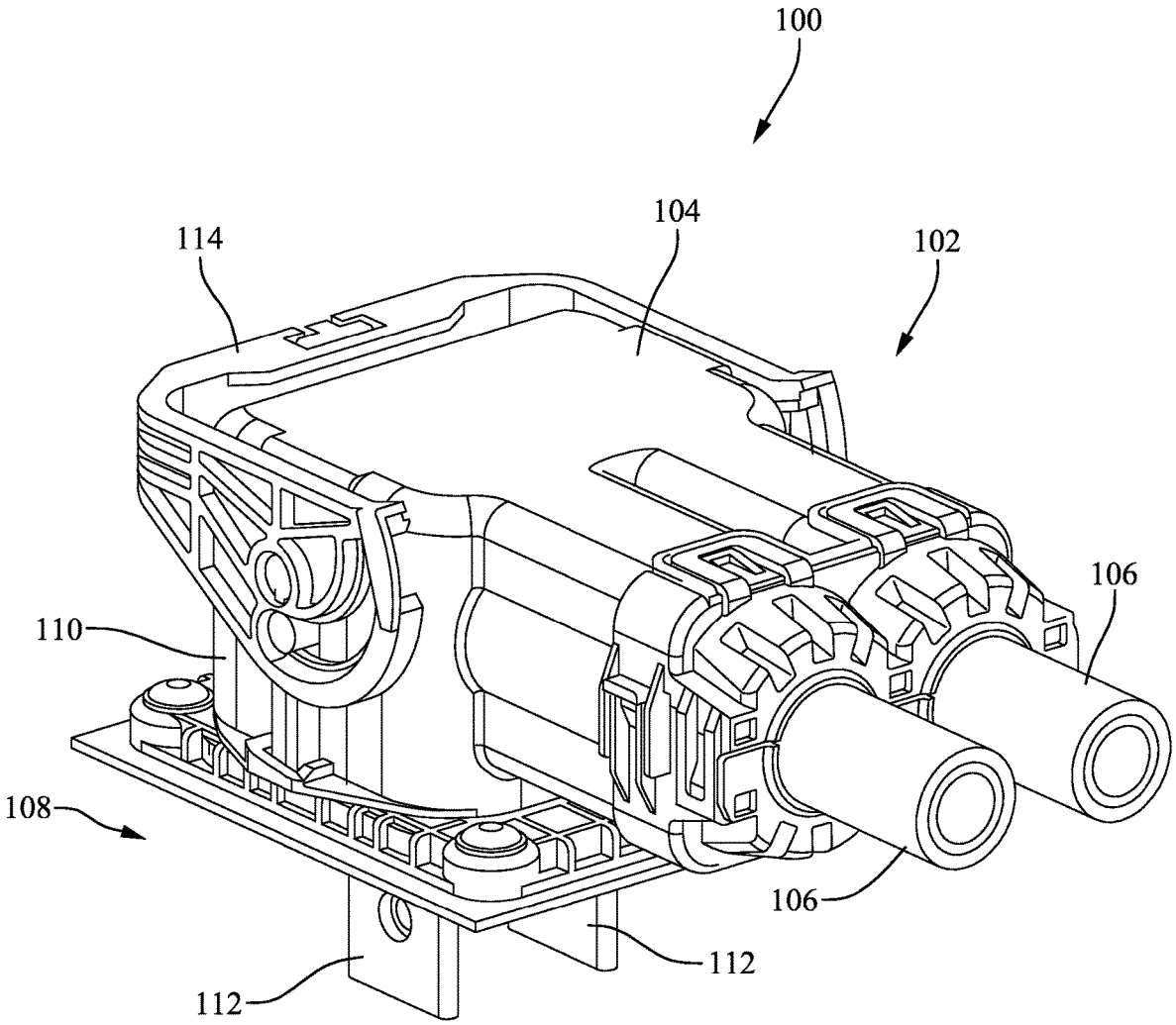
FIG. 1 is a perspective view of a shielded electrical connector assembly according to an embodiment of the invention.
Figure 2:
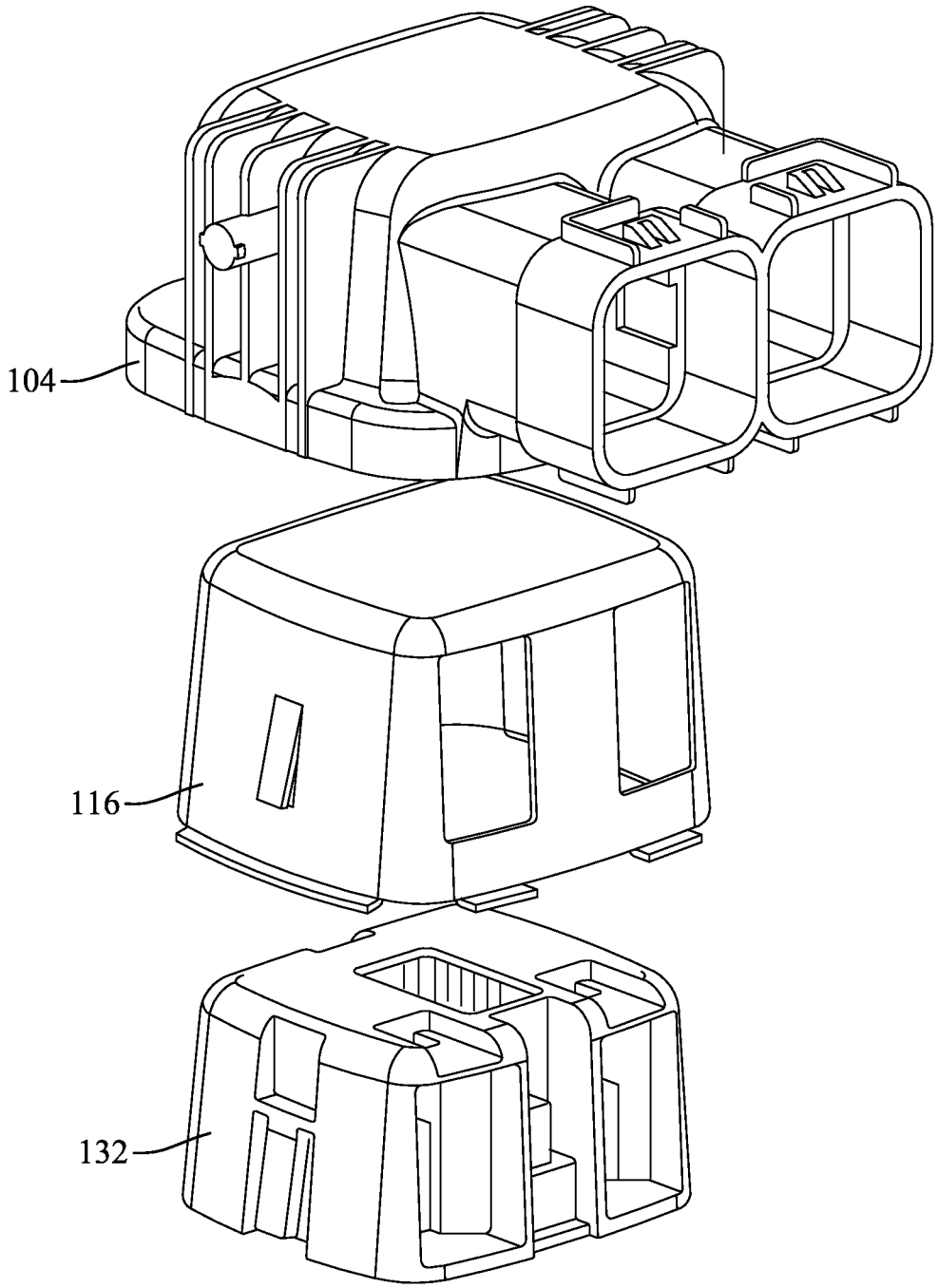
FIG. 2 is an exploded perspective view of the shielded electrical connector assembly of FIG. 1 including an electromagnetic shield according to an embodiment of the invention.

FIG. 1 illustrates an embodiment of a shielded electrical connector assembly, hereinafter referred to as the assembly 100, that includes a female connector 102 having a female connector housing or body 104 containing a pair of socket terminals (not shown) connected to a pair of shielded wire cables 106. The assembly 100 also includes a male connector 108 having a male connector housing or body 110 containing a pair of blade terminals 112 that interconnect with the socket terminals in the female connector body 104. The assembly 100 also includes a connection assist lever 114. This assembly 100 may be suited for high power electrical connections, such as those required in an electrified vehicle powertrain. The female and male connector bodies 104, 110 are formed of an electrically insulative, i.e. dielectric, material, such as an engineered polymer. The socket terminals and blade terminals 112 are formed of an electrically conductive maters, such as a copper alloy. The shielded cables each have a central conductor, such as stranded copper wire cable, supported by a polymeric inner insulator jacket. The inner jacket of each cable is surrounded by a shield conductor, such as a braided copper wire sleeve, that is surrounded by a polymeric outer insulator jacket As shown in FIG. 2, the female connector 102 includes an electromagnetic shield, hereinafter referred to as the shield 116, that is received within a connector cavity 118 (see FIG. 6) defined by the female connector body 104. The shield 116 is electrically connected to the shield conductors of the shielded wire cables 106 and surrounds at least a portion of the interface between the socket terminals and blade terminals 112. In the embodiment illustrated in FIG. 2, the shield 116 is formed of a thin conductive foil, such as an aluminum foil having a thickness of less than 0.38 millimeters (about 0.015 inches).

Figure 3:
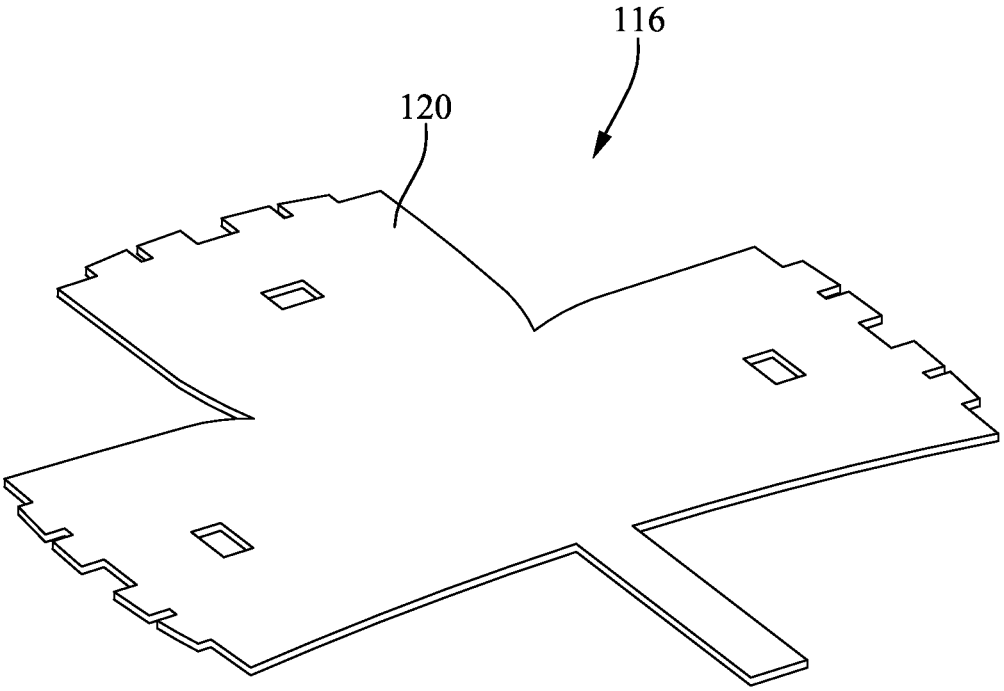
FIG. 3 is a perspective view of the preformed electromagnetic shield of FIG. 2 according to an embodiment of the invention.
Figure 4:
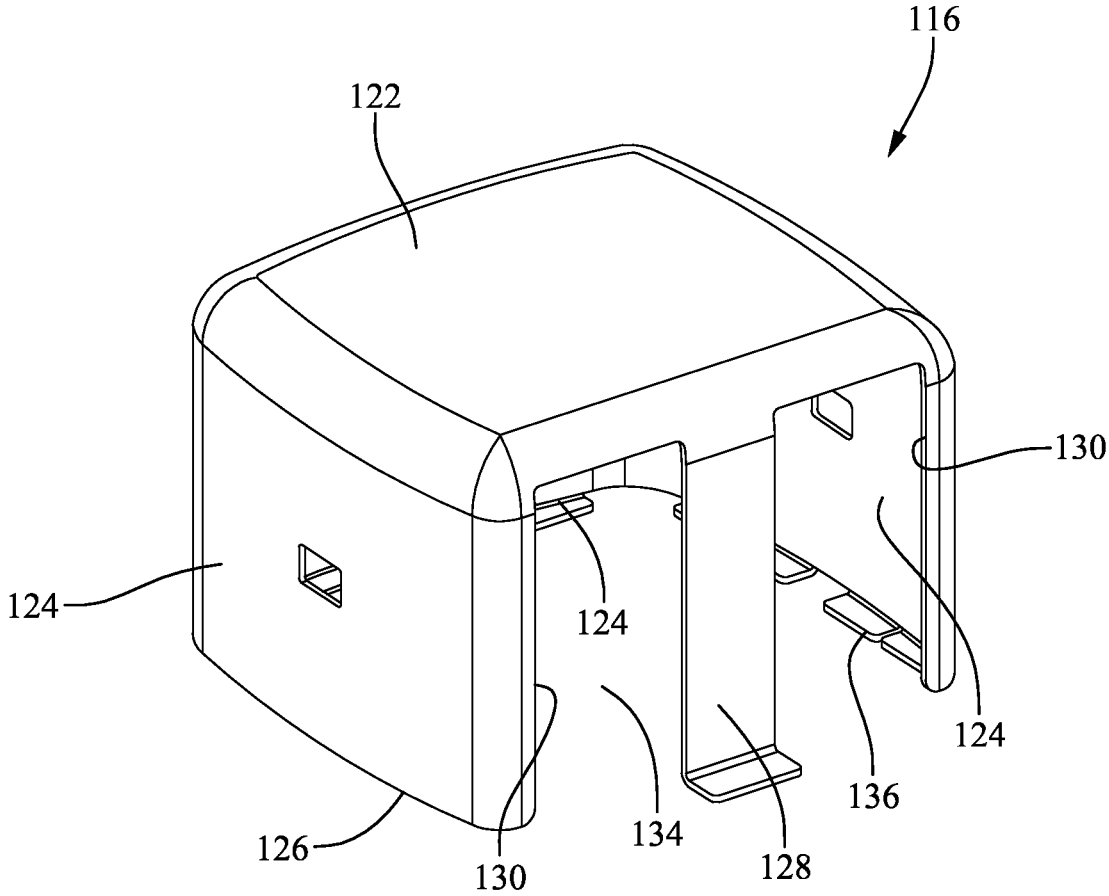
FIG. 4 is a perspective view of the formed electromagnetic shield of FIG. 3 according to an embodiment of the invention.

As shown in FIG. 3, the shield 116 is integrally formed from a planar sheet 120 of foil that is cut, e.g. blanked, to the desired shape so that after the sheet 120 is shaped, the shield 116 is characterized as having a main wall 122 and four side walls 124 surrounding the main wall 122 as illustrated in FIG. 4. The shield 116 defines an opening 126 opposite the main wall 122 having an opening perimeter that is greater than or equal to a main wall perimeter. One of the four side walls 124, e.g. a front side wall 128 defines a pair of side wall openings 130 that are configured to receive the pair of shielded wire cables 106. The foil sheet 120 may be fashioned into the shape of the shield 116 using a die and punch. The thin foil shield 116 provides the benefit of lower cost tooling and easier forming processes than prior art shields made from thicker sheet metal that required progressive dies to obtain the desired shape.

Returning to FIG. 2, the female connector 102 also includes a shield support structure, hereinafter referred to as the support 132, that is received within a shield cavity 134 formed by the main wall 122 and the four side walls 124. The support 132 is formed of an electrically insulative, i.e. dielectric, material, such as an engineered polymer. The support 132 is characterized as having a main wall and four side walls surrounding the main wall 122 as illustrated in FIG. 2. The support defines an opening opposite the main wall. A front side wall of the support 132 defines a pair of side wall openings that are configured to receive the pair of shielded wire cables 106. The support further defines a support cavity between the main wall and the four side walls in which the blade and socket terminal interface is disposed.

The support 132 enhances the rigidity of the shield 116 to allow the thin foil shield 116 to be handled without deforming or damaging the shield 116. The support 132 also provides the benefit of electrically insulating the shield 116 from the terminals, thereby preventing a short circuit between the terminals and the grounded shield 116. The support 132 may be used with a forming die during the process of forming the shield 116, wherein the support 132 serves as a punch to shape the sheet 120 into the desired shape of the shield 116. As shown in FIG. 4, the side walls 124 of the shield 116 define a plurality of tabs 136 around the opening 126 that are folded over the support 132 to secure the shield 116 to the support 132. The support 132 may also be used to insert the shield 116 into the connector cavity 118.

Figure 5:
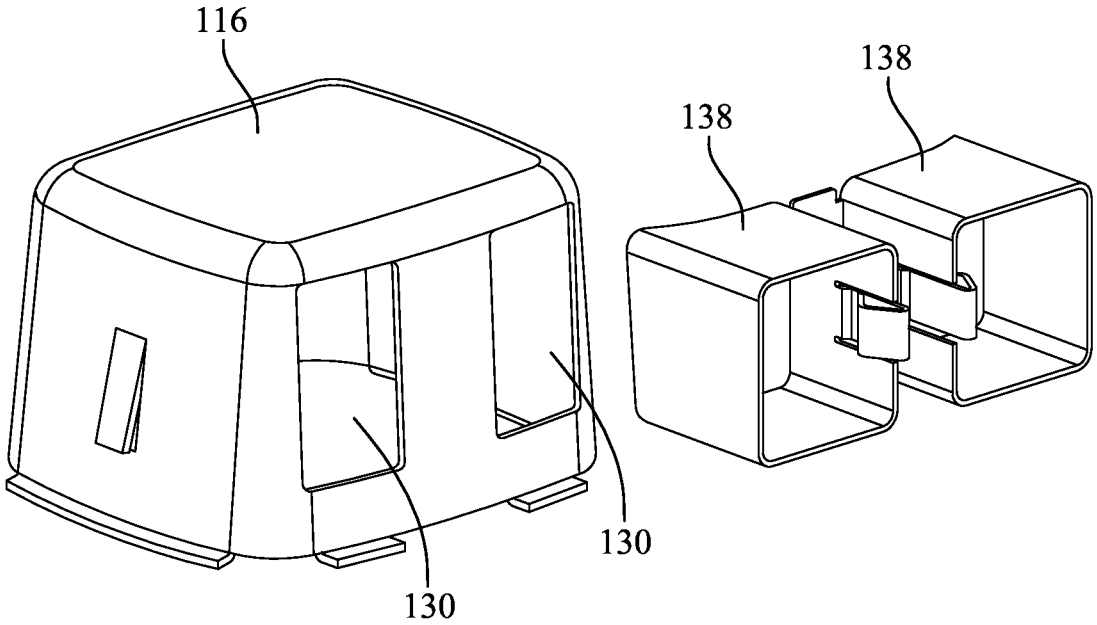
FIG. 5 is a perspective view of an alternate electromagnetic shield of the shielded electrical connector assembly of FIG. 1 according to an embodiment of the invention.

As shown in FIG. 5, the shield 116 may include shield extensions 138 that fit within the pair of side wall openings 130 to provide additional shielding along the shielded wire cables 106 within the connector cavity 118. These shield extensions 138 can be formed of sheet metal using less complex progressive die stamping.

Figure 6:
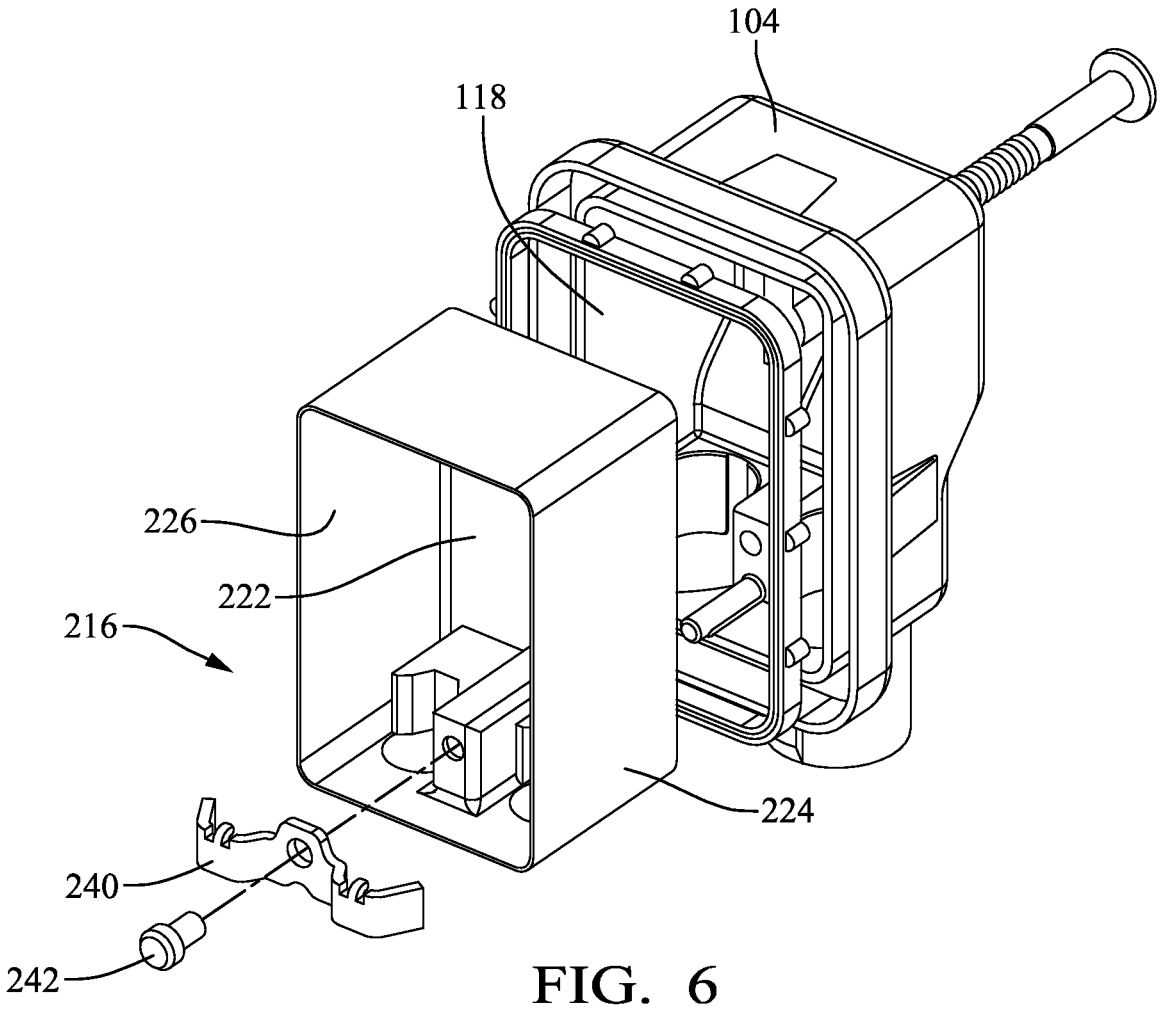
FIG. 6 is a perspective view of an alternate shielded electrical connector assembly according to an embodiment of the invention.

FIG. 6 illustrates an alternative shield construction in which the shield 216 is formed from sheet meal that is deep drawn into the desired shape having a main wall 222 and four side walls 224 surrounding the main wall 222, wherein the shield 216 defines an opening 226 opposite the main wall 222 having an opening perimeter that is greater than or equal to a main wall perimeter. The shield 216 also includes a clamp 240 that secures shield conductors of the shielded wire cables 106 to the shield 216, e.g. by a threaded fastener 242. This shield 216 provides the benefit of eliminating seams between the side walls 224.

Figure 7:
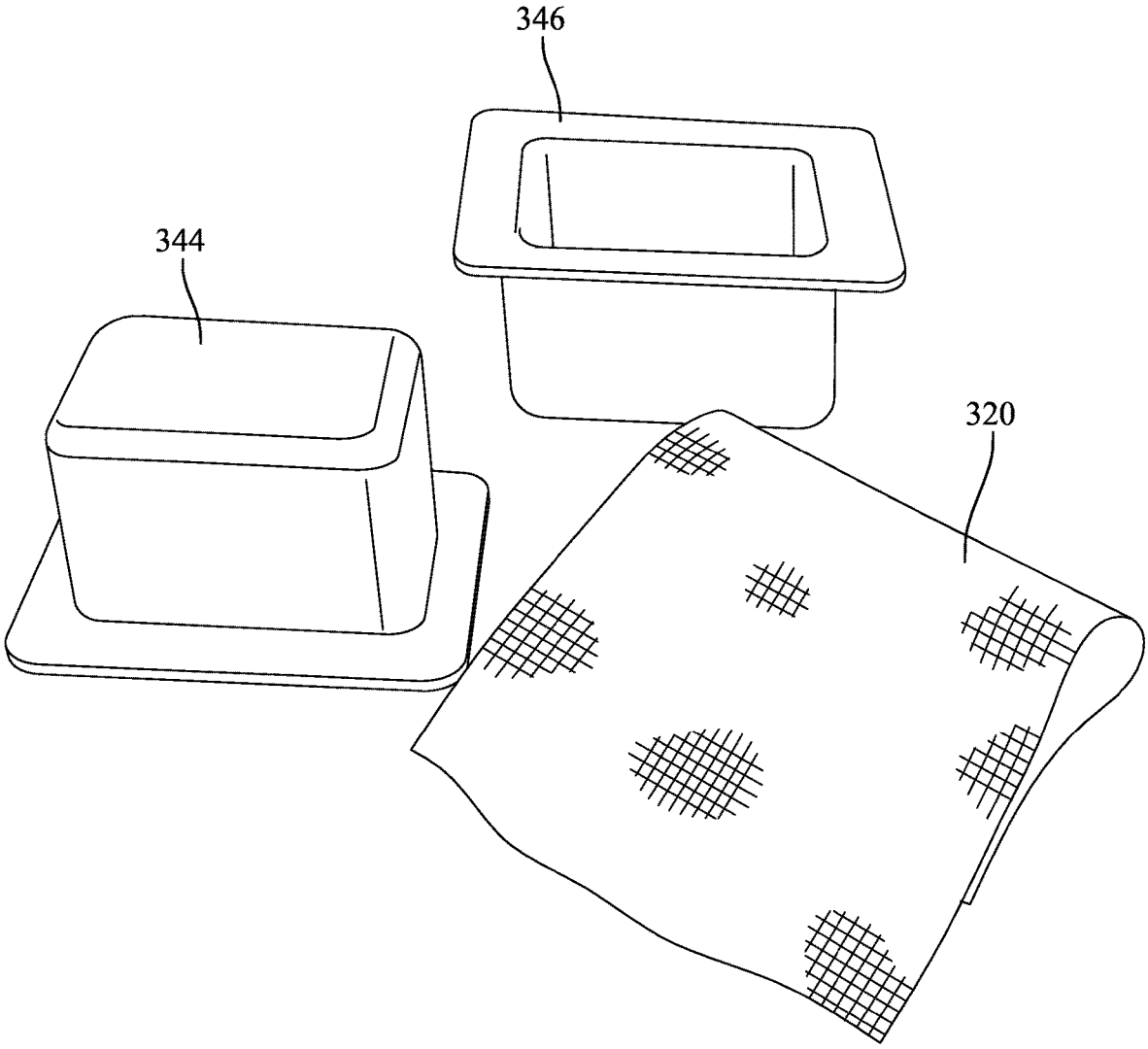
FIG. 7 is an isolated perspective view of an alternative preformed electromagnetic shield according to an embodiment of the invention.
Figure 8:
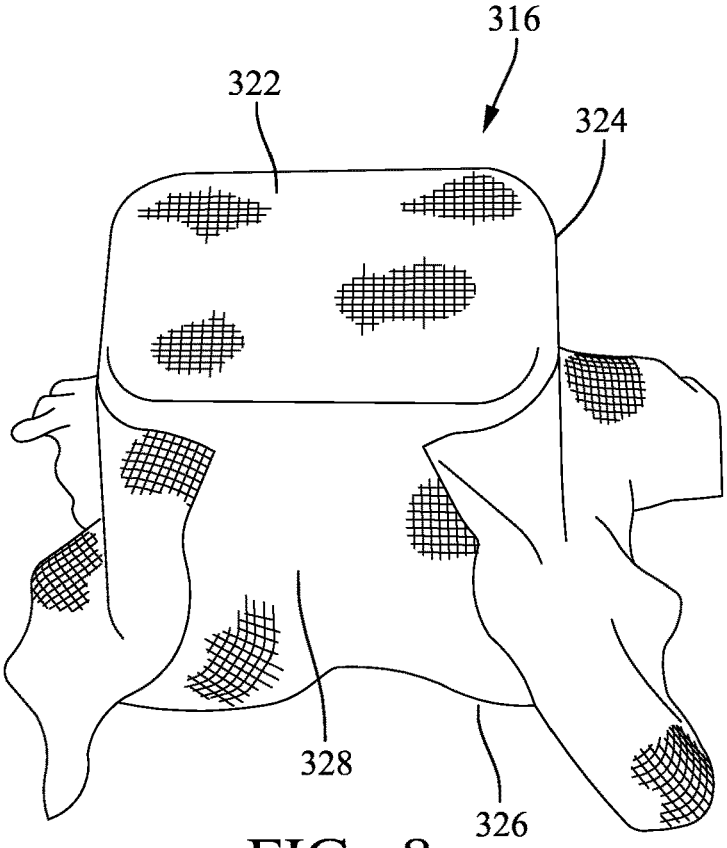
FIG. 8 is an isolated perspective view of electromagnetic shield of FIG. 7 in an intermediate forming step according to an embodiment of the invention.
Figure 9:
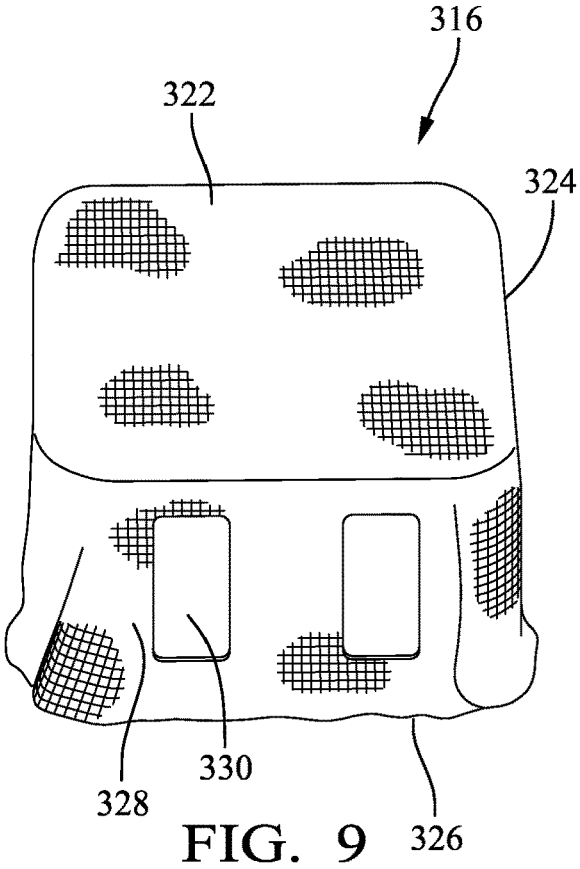
FIG. 9 is an isolated perspective view of electromagnetic shield of FIG. 7 after forming according to an embodiment of the invention.

FIGS. 7 to 9 illustrate yet another alternative shield construction in which the shield 316 is formed from a sheet 320 of expanded metal mesh or screen, such as expanded aluminum. The sheet 320 of expanded aluminum is formed using a die 344 and a punch 346 into the desired shape having a main wall 322 and four side walls 324 surrounding the main wall 322, wherein the shield 316 defines an opening 326 opposite the main wall 322 having an opening perimeter that is greater than or equal to a main wall perimeter. After removal from the die 344, the shield 316 is trimmed and the pair of side wall openings 330 is cut in the front side wall 328. The support 132 may be used to enhance the rigidity of the shield 316 to allow the shield 316 to be handled without deforming or damaging the shield 316. The support 132 may serve as the punch 346 to shape the expanded aluminum sheet 320 into the desired shape of the shield 316. This shield 316 also provides the benefit of eliminating seams between the side walls 324.

Figure 10:
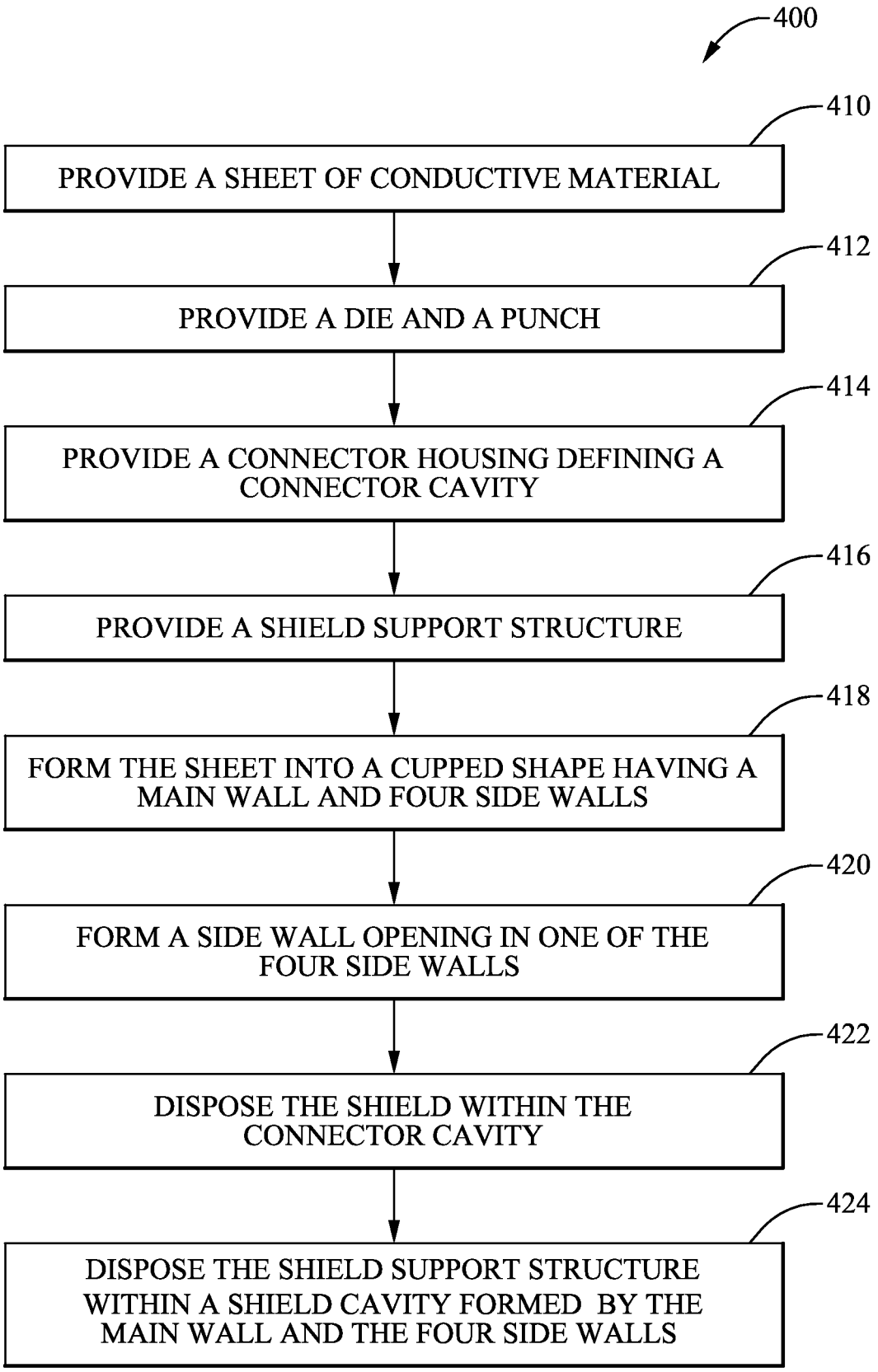
FIG. 10 is a flow chart of a method of manufacturing a shielded electrical connector assembly according to an embodiment of the invention.

FIG. 10 illustrates a method 400 of manufacturing the assembly 100. The method 400 includes the following steps:

STEP 410, PROVIDE A SHEET OF CONDUCTIVE MATERIAL, includes providing a single planar sheet 120 of conductive material, such as a sheet of aluminum foil.

STEP 412, PROVIDE A DIE AND A PUNCH, includes providing a die 344 and a punch 346 configured to form the sheet 120 into the desired shape of the shield 116.

STEP 414, PROVIDE A CONNECTOR HOUSING DEFINING A CONNECTOR CAVITY, includes providing the female connector housing 104 defining the connector cavity 118.

STEP 416, PROVIDE A SHIELD SUPPORT STRUCTURE, includes providing the support 132.

STEP 418, FORM THE SHEET INTO A CUPPED SHAPE HAVING A MAIN WALL AND FOUR SIDE WALLS, includes forming the sheet 120 into a cupped shape having a main wall 122 and four side walls 124 surrounding the main wall 122 using the die 344 and the punch 346. The cupped shape defines an opening 126 opposite the main wall 122 having an opening perimeter that is greater than or equal to a main wall perimeter.

STEP 420, FORM A SIDE WALL OPENING IN ONE OF THE FOUR SIDE WALLS, includes forming at least one side wall opening in one of the four side walls 124.

STEP 422, DISPOSE THE SHIELD WITHIN THE CONNECTOR CAVITY, includes disposing the shield 116 within the connector cavity 118.

STEP 424, DISPOSE THE SHIELD SUPPORT STRUCTURE WITHIN A SHIELD CAVITY FORMED BY THE MAIN WALL AND THE FOUR SIDE WALLS, includes disposing the support 132 within a shield cavity 134 formed by the main wall 122 and the four side walls 124. STEP 424, DISPOSE THE SHIELD SUPPORT STRUCTURE WITHIN A SHIELD CAVITY FORMED BY THE MAIN WALL AND THE FOUR SIDE WALLS, may be performed simultaneously with STEP 418, FORM THE SHEET INTO A CUPPED SHAPE HAVING A MAIN WALL AND FOUR SIDE WALLS when the support is used as the punch 346.

As presented herein, a shielded electrical connector assembly 100 and a method 400 of manufacturing this shielded electrical connector assembly 100 is provided. The assembly 100 and the method 400 provide the benefits of reduced manufacturing cost because the sheet 120 may be blanked and formed into the shield 116 in two processes requiring only two workstations. Softer, lower cost metal foil or expanded metal can be used for the shield 116 because it is mechanically supported by the support 132 and may be immediately inserted into the connector cavity 118 where it is protected from handling damage.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A shielded electrical connector assembly, comprising:

an electromagnetic shield integrally formed from a single sheet of conductive material, said shield having a main wall and four side walls surrounding the main wall that define a shield cavity, said shield defining an opening opposite the main wall having an opening perimeter that is greater than or equal to a main wall perimeter, wherein one of the four side walls defines a side wall opening configured to receive a shielded wire cable;

a connector housing defining a connector cavity in which the shield is received; and a shield support structure received within the shield cavity, wherein the electromagnetic shield surrounds the shield support.

2. The shielded electrical connector assembly according to claim 1, wherein the shield is formed from a planar sheet.

3. The shielded electrical connector assembly according to claim 1, wherein the planar sheet is a metallic foil having a thickness of less than 0.38 millimeters.

4. The shielded electrical connector assembly according to claim 1, wherein the planar sheet is a formed of an expanded metal sheet.

5. The shielded electrical connector assembly according to claim 4, wherein the planar sheet is a formed of an expanded aluminum sheet.

6. The shielded electrical connector assembly according to claim 1, wherein the connector housing is formed of a dielectric material.

7. The shielded electrical connector assembly according to claim 1, wherein the shield support structure is formed of a dielectric material.

8. The shielded electrical connector assembly according to claim 1, wherein the sheet is formed by the shield support structure.

9. The shielded electrical connector assembly according to claim 1, wherein the one of the four side walls defines a pair of side wall openings, each configured to receive one shielded wire cable of a pair of shield wire cables.

10. A method of manufacturing a shielded electrical connector assembly, comprising the steps of:

providing a single planar sheet of conductive material;

providing a die and a punch;

forming the sheet into a cupped shape having a main wall and four side walls surrounding the main wall using the die and the punch, said cupped shape defining an opening opposite the main wall having an opening perimeter that is greater than or equal to a main wall perimeter;

forming a side wall opening in one of the four side walls;

providing a connector housing defining a connector cavity;

disposing the shield within the connector cavity;

providing a shield support structure; and disposing the shield support structure within a shield cavity formed by the main wall and the four side walls.

11. The method according to claim 10, wherein the planar sheet is a metallic foil having a thickness of less than 0.38 millimeters.

12. The method according to claim 10, wherein the planar sheet is a formed of an expanded metal sheet.

13. The method according to claim 12, wherein the planar sheet is a formed of an expanded aluminum sheet.

14. The method according to claim 10, wherein the step of disposing the shield support structure within the shield cavity is performed simultaneously with the step of forming the sheet into the cupped shape.

15. A shielded electrical connector assembly manufactured by a process comprising the steps of:

providing a single planar sheet of conductive material;

providing a die and a punch;

forming the sheet into a cupped shape having a main wall and four side walls surrounding the main wall using the die and the punch, said cupped shape defining an opening opposite the main wall having an opening perimeter that is greater than or equal to a main wall perimeter;

forming a side wall opening in one of the four side walls;

providing a connector housing defining a connector cavity;

disposing the shield within the connector cavity;

providing a shield support structure; and disposing the shield support structure within a shield cavity formed by the main wall and the four side walls.

16. The shielded electrical connector assembly according to claim 15, wherein the step of disposing the shield support structure within the shield cavity is performed simultaneously with the step of forming the sheet into the cupped shape.

17. The shielded electrical connector assembly according claim 15, wherein the planar sheet is a metallic foil having a thickness of less than 0.38 millimeters.

18. The shielded electrical connector assembly of claim 1, further including:

one or more shield extensions configured to fit within the at least one side wall openings.

* * * * *